United States Patent [19]

Jaton

[11] 3,986,441

[45] Oct. 19, 1976

[54] METHOD AND APPARATUS FOR APPLYING A REINFORCING LINING BLANK IN A DESIRED POSITION ONTO A SURFACE OF A BOX BLANK

[75] Inventor: Jean-Philippe Jaton, Chapelle, Moudon, Switzerland

[73] Assignee: J. Bobst & Fils S.A., Switzerland

[22] Filed: Feb. 21, 1975

[21] Appl. No.: 551,672

[30] Foreign Application Priority Data

Feb. 22, 1974 Switzerland ..... 2502/74

[52] U.S. Cl. ..... 93/36.6; 93/36.01; 156/556

[51] Int. Cl.[2] ..... B31B 1/02

[58] Field of Search ..... 93/36.6, 36.01, 36 R, 93/36 M; 270/58; 156/556, 557

[56] References Cited

UNITED STATES PATENTS

| | | | |
|---|---|---|---|
| 2,605,920 | 8/1952 | Hammel | 270/58 X |
| 3,540,970 | 11/1970 | Huntwork | 93/36.6 UX |
| 3,547,013 | 12/1970 | Gentry | 93/36.6 |
| 3,709,110 | 1/1973 | Lubersky | 93/36.6 |
| 3,800,678 | 4/1974 | Wiedmann et al. | 93/36.6 |

*Primary Examiner*—James F. Coan

*Attorney, Agent, or Firm*—Hill, Gross, Simpson, Van Santen, Steadman, Chiara & Simpson

[57] ABSTRACT

A method and apparatus for applying a reinforcing liner blank on a moving box blank and shifting the assembled blank into the desired position for a subsequent attachment together characterized by a first belt moving a box blank in one direction, a second belt moving a liner blank and guiding it into surface-to-surface engagement on the moving box blank and the belts coacting to move the box blank and with the liner engaged thereon and cooperating with a shifting device which moves the blanks relative to each other to the desired position prior to joining the blanks together. The shifting device includes at least one endless chain belt having an abutment for engagement by the leading edge of the box blank and a second abutment for engagement by the leading edge of the liner blank which abutments coact with the respective belts to cause slippage of their respective blank on the belt when the leading edge is engaged. Preferably, the apparatus and method include a device for sequentially feeding a box blank into a transporting device which includes the belt engaging the box blank and a similar feeding device for sequentially feeding liner blanks into a transporting device which includes the belt for moving and guiding the liner blanks into the surface engagement with the box blank.

13 Claims, 7 Drawing Figures

16
22
35
33
39
36
30
37
29
27
28
8
26
2
80
25
11
5
IV
IV
III
III
V
V

METHOD AND APPARATUS FOR APPLYING A REINFORCING LINING BLANK IN A DESIRED POSITION ONTO A SURFACE OF A BOX BLANK

BACKGROUND OF THE INVENTION

1. Field of the Invention

The present invention is directed to a method and apparatus for applying a reinforcing liner blank in a desired position on a surface of a box blank prior to attachment thereto and particularly prior to performing a folding and gluing operation on the attached or assembled blanks.

2. Prior Art

In prior art methods and apparatuses for positioning a liner blank on a box blank for subsequent attachment, problems exist in transporting the blanks and positioning the blanks in the desired assembled relationship for attachment.

One device which has been proposed for positioning the engaged blanks in the desired relationship includes a lower endless chain with catches or driving dogs which engage contact dogs which engage a rear or trailing edge of the blanks to move the blanks through the device. It has also been proposed to feed the blanks from a stack onto the moving chains by the use of distributing dogs which engage a trailing edge of a lowermost blank in the stack to shift the blank relative to the stack. To position the liner blank on the box blank, the box blank is conveyed by the chains to a given position and held at that position. The liner blank is conveyed by the other chains to a position above the held box blanks and then released and deposited on the stationary box blank. Then the box blank with the liner blank deposited thereon is transported to the next station.

In the proposed design utilizing contact and distributing dogs, the dogs engage the trailing edge of the blank with an impact which is likely to damage an edge of a blank having a certain board quality. This is especially true of corrugated boards which have a corrugated layer having undulation with parallel extending crests and troughs. If the edge of the blank extends parallel and along a crest or trough of an undulation of the corrugated layer, the resistance of the edge is insufficient. If the edge extends transverse or across a plurality of the undulations, the resistance might be sufficient, but the toughness features are generally inadequate to withstand the impacting blows of the dogs without damage to the edge of the blank.

Another difficulty with transporting the blanks by pushing with dogs engaging a rear or trailing edge is the tendency of the blank to bend or curve upward as it is pushed through the device.

In the above-mentioned proposed device utilizing dogs engaging the trailing edges of the blanks, the reinforcing liner blank is moved to a position and then dropped onto the stationary box blank. This requires a discontinuous motion for the blanks in both time and space.

SUMMARY OF THE INVENTION

The present invention is directed to a method and apparatus for applying a reinforcing liner blank in a desired position on the surface of a box blank prior to attachment or joining thereto. The method and apparatus enables the positioning with a smooth movement of the blanks without pushing the rear edges of the blank and without engaging the edges with an impact force to cause damage thereto.

To accomplish these features, the method and apparatus comprises means for moving a box blank in one direction, means for moving a reinforcing liner blank and guiding the moving liner blank into surface-to-surface engagement with the moving box blank, and while moving the box blank with the liner blank engaged thereon shifting the box blank and liner blank relative to each other and into the desired assembled relationship so that the liner blank is in the desired position on the box blank when attached thereto. Preferably, the means for moving the box blank is a first endless belt, means for supporting the first endless belt for movement in a first endless path and means for moving the belt in one direction along the first path. The means for moving and guiding the liner blank preferably includes a second endless belt, means for supporting the second endless belt for moving along an endless path having a portion inclined to the first endless path and a second portion extending parallel to the first endless path and means for moving the second belt along the second path. The means for shifting preferably includes at least one endless chain belt having a first abutment means supported thereon for engaging the leading edge of a box blank and a second abutment means for engaging a leading edge of a liner blank which abutments coact with the moving belt to cause slippage between the engaged surfaces of the blanks and each blank and its respective belt to move the blanks relative to each other and to the desired position. The apparatus preferably includes feeding means for feeding blanks sequentially onto the first belt and a second feeding means for sequentially feeding the liner blanks into engagement with the second belt.

DESCRIPTION OF THE PREFERRED EMBODIMENTS

Figure 1:
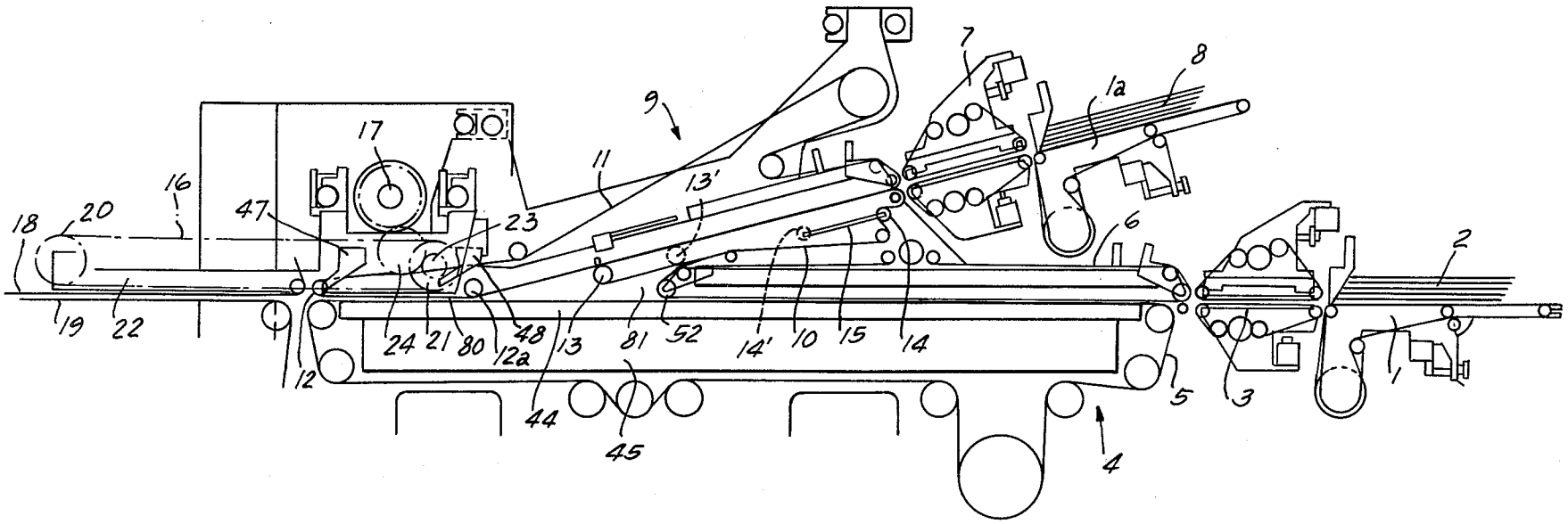
FIG. 1 is a diagrammatic side view of an apparatus according to the present invention for performing the method of the present invention.

The principles of the present invention are particularly useful in an apparatus diagrammatically illustrated in FIG. 1. The apparatus of FIG. 1 has a frame for supporting various devices including feeding means illustrated as a first feeding device 1 for sequentially feeding a blank 2 from a pile of blanks into a conveying device illustrated as a belt conveyor 3. The feeding device 1 utilizes an endless belt which is intermittently advanced to transport the bottommost blank 2 from the pile and a more detailed description of this device is contained in my copending U.S. patent application, Ser. No. 441,438 filed Feb. 11, 1974 which issued on Sept. 23, 1975, as U.S. Pat. No. 3,907,278. Coaction of the devices 1 and 3 provide a timed feed of a box blank 2 into a blank moving means, generally indicated as a belt conveyor means 4 which has at least one lower endless belt 5 and at least one upper endless belt 6. The conveyor means 4 includes separate means for supporting each of the belts 5 and 6 for movement in an endless path and means for driving each of the endless belts 5 and 6.

The apparatus also includes means for sequentially feeding reinforcing liner blanks 8 from a pile which means, as illustrated, is a feeding device 1*a* which is identical to the device 1. The device 1*a* feeds the lowermost liner blank 8 from the pile into a conveying device 7 and coacts therewith to feed the blank 8 at the desired time interval into a linear blank moving and guiding means illustrated as a belt conveyor 9 which includes at least one lower endless belt 10 and at least one upper endless belt 11. The conveying device 9 includes means for supporting each of the endless belts 10 and 11 in an endless path and means for moving each of the belts along their respective paths. As illustrated, the plane of travel of the liner blank 8 from the feeding device 1*a* through the conveyor 7 and into the conveyor device 9 is in a plane which is inclined to the plane of travel of the box blanks 2 transported by the conveying device 4. As mentioned, the driving means and supporting means for each of the belts of the conveyors 4 and 9 which supporting means includes tensioning devices are conventional elements for belt conveyors and not illustrated in detail.

A special feature of the conveyor 4 is that the upper belt or belts 6 extend only over a part of the length of travel of the lower belts 5. In the belt conveyor 9, the path of the upper belt or belts 11 has an incline portion and has a horizontal portion 80 which is defined by the rollers 12 and 12*a* which horizontal portion extends parallel to a path of the lower belt 5 of the conveyor 4 and coacts therewith to move a pair of superimposed blanks. The lower belts 10 of the conveyor 9 only extend along a portion of the inclined portion of the path of the belts 11. The length of this portion is controlled by the position of the roller 13 which may be adjusted between the position illustrated in bold lines to a position indicated at 13' and the support means for the belt or belts 10 includes a take-up roller 14 which is movable in a slot 15 to an inward position indicated at 14'. The adjustable position of the roller 13 enables the machine to be adjusted for various lengths of the blanks being processed.

Along the track defined by the upper belt or belts 6 of the conveyor 4 the device can be provided with folding and prebreaking devices which are known in the art to act on the box blank as it is being conveyed between the belts 5 and 6. Also, the device may include an adhesive applicating means for applying an adhesive such as glue onto the upper surface of the box blank 2 as it is disengaged by the upper belt or belts 6. The applicating means is a conventional adhesive applying device which may either apply the adhesive at predetermined points or as a continuous layer and the device which is not illustrated is located generally in the area indicated by the element 81.

On the left-hand end of the machine frame as illustrated in FIG. 1, a pair of endless chains 16 are provided. The chains 16, which are sprocket type chains, move on an endless path which is defined by gears or sprocket wheels 20,21 with a portion of the path extending parallel to the common track of the belt 5 and the portion 80 of the belts 11. The endless chains 16 ensure the position of the reinforcing liner blank 8 on the box blank 2 whether or not an adhesive has been applied thereto as the superimposed blanks are moved by the coaction of the belts 5 and 11. The endless chains 16 move at a slightly lesser speed than the belt 5 and are driven by means of toothed wheel or gear 17 which meshes with a counter gear 24 which in turn meshes with a pinion 23 which is keyed on the shaft of the gear 21.

As illustrated, the chains 16 whose gear wheels 20 and 21 are supported in frame members 22 extend passed the termination of the belts 5 and 11 and remain in contact with the superimposed aligned blanks as they are discharged into a prebreaker whose inlet is schematically presented by the belts 18 and 19.

Figure 2:
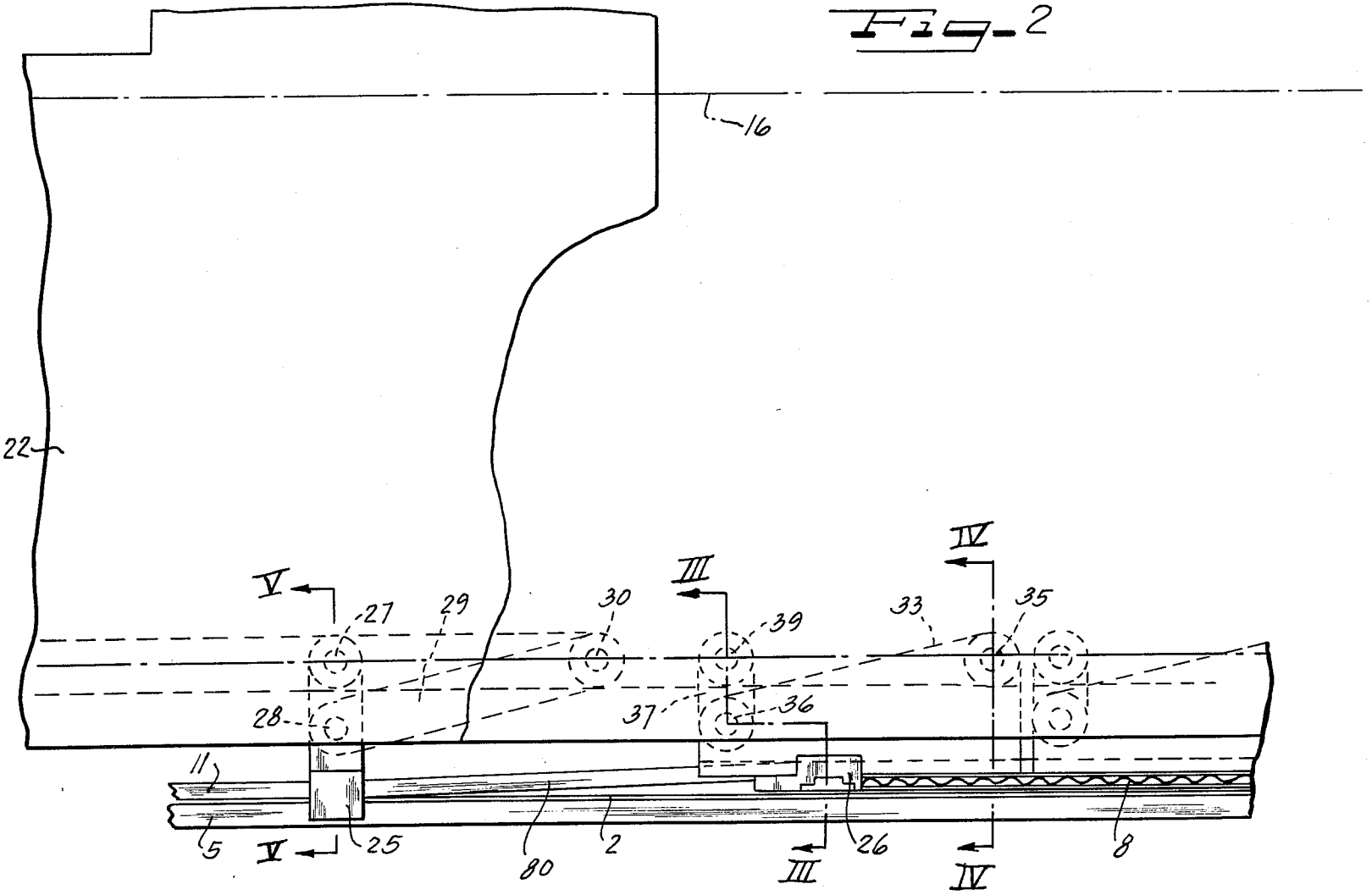
FIG. 2 is an enlarged side view with portions broken away of the apparatus of FIG. 1 illustrating the shifting means of the present invention.

Referring to FIGS. 2–5, each endless chain 16 includes a certain number of first abutment means 25 for engaging a leading edge of the blank 2 and a certain number of second abutment means 26 for engaging the leading edge of the liner blanks 8. The spacing between the first abutment means on the chain 16 is dependent on the length of the box blank 2 and the desired spacing between successive moving blanks 2. Each first abutment means 25 (FIG. 5) includes three rectangular blocks 52, 53, 54 which are assembled in a sandwichwise relation on two parallel-vertical plates 55, 55*a* by means of a threaded fastener such as a screw 56. The block 53 acts as an intermediate or spacing piece between the plates 55 and 55*a*, which are joined to the chain 16 by means of a pin or axle 27 which extends past the sides of the chain and receives cylindrical rollers or blocks 57 and 57*a*. The rollers 57 and 57*a* are held on the shaft or pin 27 which may have its ends deformed or expanded in a manner similar to a hollow rivet. The roller 57 is received between a pair of guide members 58 and 59 mounted on a frame member 22 which members define a groove 40. In a similar manner, the roller or block 57*a* is received between guide members 58*a* and 59*a* which are carried on a frame member 22*a* and define a groove 41. Between the pin 27 and the abutment means 25, the plates 55 and 55*a* are connected to parallel connecting rods or links 29 and 29*a* by means of a shaft or pin which also supports an intermediate piece 60 which acts as a spacing between the plates 55 and 55*a*. As best illustrated in FIG. 2, the other end of the connecting rods 29 and 29*a* are connected to the endless chain 16 by means of a shaft or pin 30. The connecting rods 29 and 29*a* ensure the position of the first abutment means 25 and enable rotation of the endless chain 16 on its gears or sprocket wheels 20 and 21.

Figure 3:
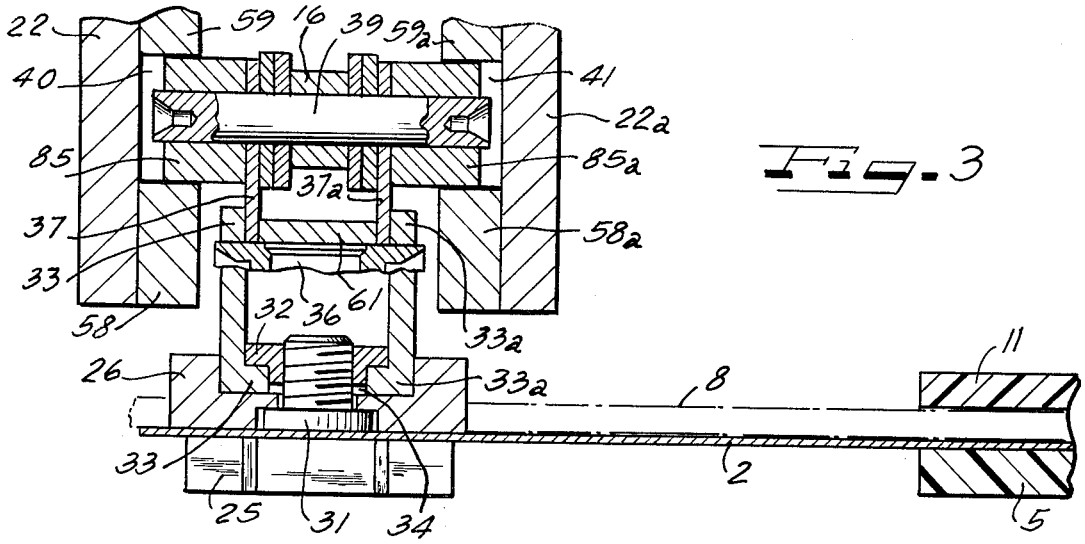
FIG. 3 is a partial cross-sectional view with portions in elevation for purposes of illustration taken along lines III—III of FIG. 2.
Figure 4:
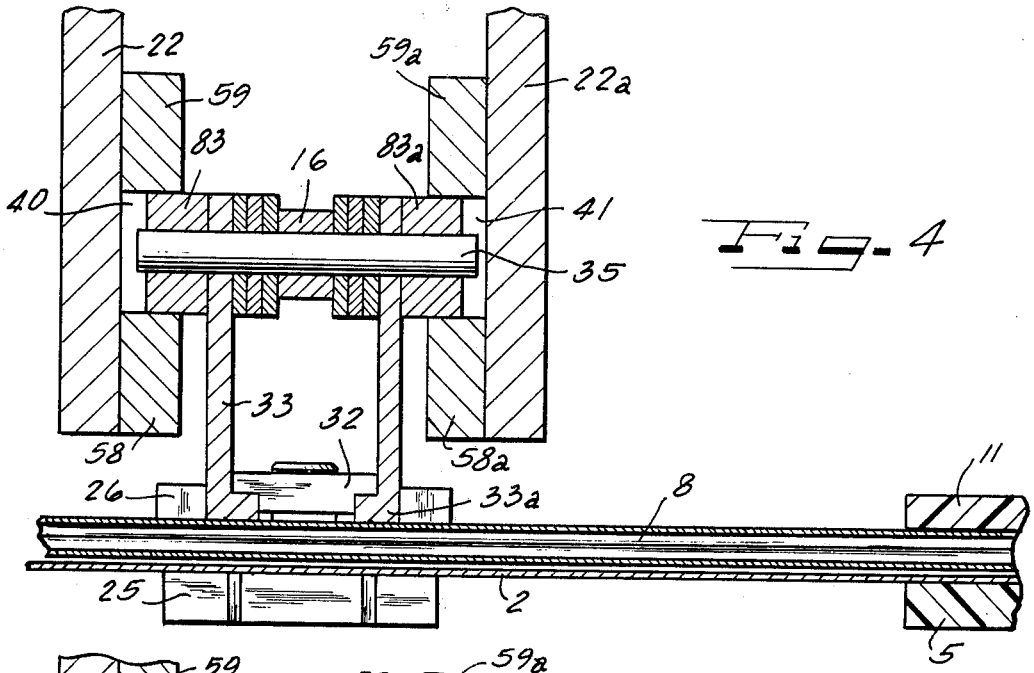
FIG. 4 is a partial cross-sectional view with portions in elevation for purposes of illustration taken along lines IV—IV of FIG. 2.
Figure 5:
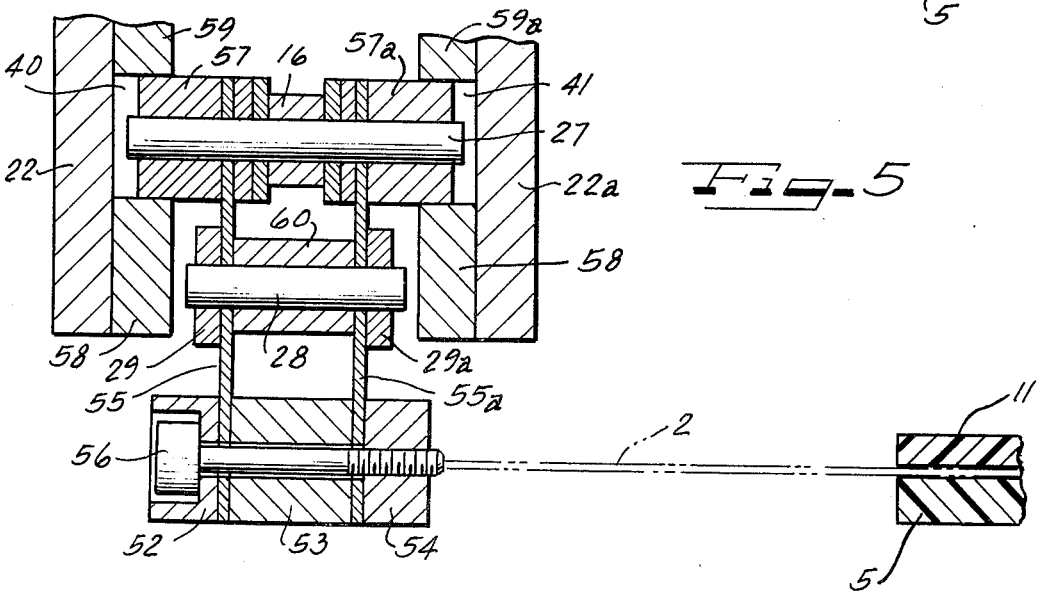
FIG. 5 is a partial cross-sectional view with portions in elevation for purposes of illustration taken along lines V—V of FIG. 2.

The second abutment means 26 are connected in a similar fashion to the endless chains 16. However, their position on the chains 16 relative to the first abutment means 25 can be modified. The second abutment means is adjustably connected on a pair of parallel plates 33 and 33*a* by means of a screw 31 threaded into a T-nut 32. The plates 33 and 33*a* as illustrated in FIG. 3 have an L-shaped profile formed by an inturned flange on the lower edge of the plate which flanges coact to form a sliding track along which the abutment means 26 can be adjusted by means of the fastening means formed by the screws 31 and the nut 32. The plates 33 and 33*a* have trapezoidal shape (FIG. 2) and are connected to the endless chains 16 by means of a pin or shaft 35 which has rollers or cylindrical blocks 83 and 83*a* disposed on the extending ends and received in the grooves 40 and 41. The forward end of each of the sides 33, 33*a* are connected by a pin 36 to connecting links 37, 37*a* which connecting links are spaced by a spacing member 61 received on the pin 36. The other end of the connecting links 37 and 37*a* are connected by a pin 39 to a link of the chain 16 and the pin 39 supports rollers or cylindrical blocks 85 and 85*a* which are also received in the grooves 40 and 41.

Figure 6:
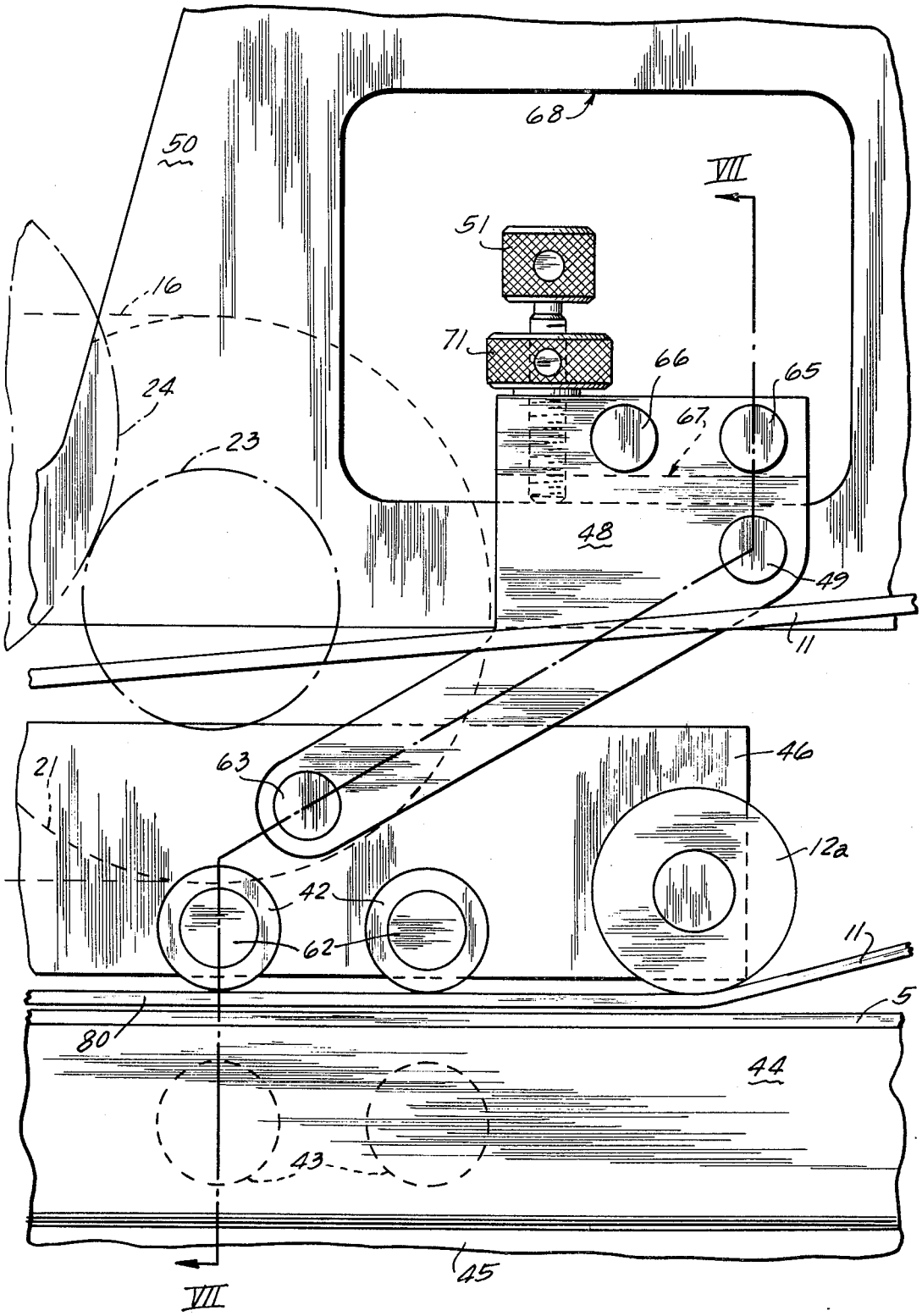
FIG. 6 is a partial side view with portions broken away and removed for purposes of illustration of the device for supporting the belts.
Figure 7:
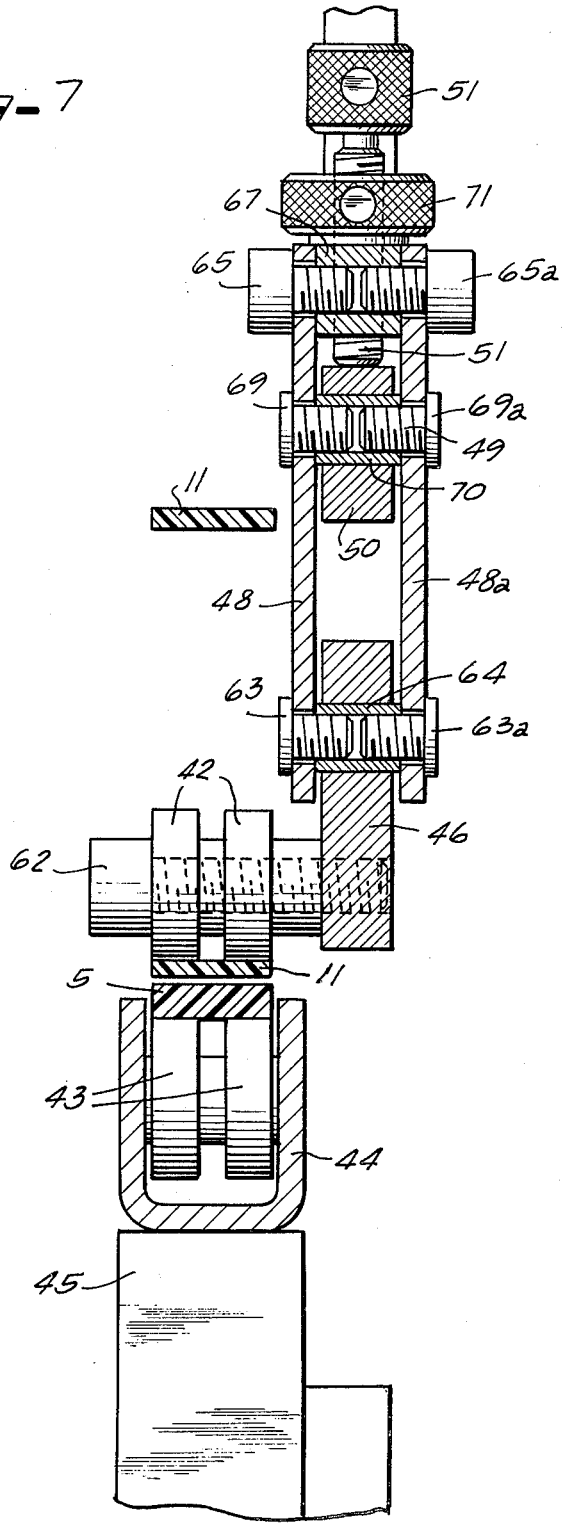
FIG. 7 is a partial cross-sectional view with portions in elevation for purposes of illustration taken along lines VII—VII of FIG. 6.

As best illustrated in FIGS. 6 and 7, the support means for the lower belt 5 includes a plurality of fixed rollers 43 which are mounted for rotation in a U-shaped or channel member 44 which is supported on a frame member 45. However, the means for supporting the belt 11 includes the roller 12*a* and a plurality of pressure rollers 42. The pressue rollers 42 are mounted for rotation on a movable beam 46 by thread fasteners such as a threaded axle 62. In a similar manner, the roller 12*a* is also mounted.

The movable beam 46 is suspended at two points on two pairs of oscillating braces 47 and 48 with each brace being composed of two members such as members 48 and 48*a* (FIG. 7). The beam is suspended on the pair of members 48 and 48*a* by means of two screws 63, 63*a* which are received in a threaded bearing bushing or intermediate piece 64 disposed is an aperture in member 46 and which member 64 acts as a rigid connection for the two members 48 and 48*a*. The upper ends of these members are connected to one another at two points in a similar manner by screws 65 and 66 which engage a common intermediate piece 67. The upper end is received in an aperture 68 of a frame member 50 with the member 48 and 48*a* extended on opposite sides thereof and is pivotably connected to the frame 50 by a pivot connection 49. The connection 49 is formed by a pair of screws 69, 69*a* threaded into a bearing bushing 70 received in an aperture in the member 50. The member 67 receives an adjustment or stop screw 51 which has a stop nut 71. The adjustment screw 51 extends through the member 67 and engages a periphery of the opening 68 to limit movement of the oscillating brace 48 in a counterclockwise direction and thus limit the amount of movement of the rollers 12*a* and 42 toward the fixed rollers 43 supporting the lower belt 5. The brace 47 is mounted in a similar fashion so that the beam 46 may oscillate vertically relative to the fixed channel 44.

The rollers 42 due to this mounting arrangement will apply preloading pressure on the blanks passing between portion 80 of the belt 11 and the belt 5. This pressure is determined by the weight of the beam 46 along with the weight of the oscillating braces 47 and 48. When blanks of a different size are used, adjustment of the adjustment screws 51 enables adjusting the amount of pressure and changing the clearance between the two belts 11 and 5 and therefore allows the controlling of the amount of pressure applied on the superimposed blanks being moved by the portion 80 of the belt 11 and the belt 5.

In operation, a box blank 2 and a reinforcing liner blank 8 are introduced into the respective conveying devices 4 and 9 with the device 1*a* introducing the blank 8 after the device 1 has introduced blank 2. Preferably, the lag between the introduction is so the leading edge of blank 8 is placed in a following relation to the leading edge of blank 2. It is also preferred that the belt 11 of the conveyor 9 moves at a slightly faster rate than the belt 5. The purpose of the lag between the introduction of the box blank 2 and the liner blank 8 is to ensure the guiding of the blank 8 onto a surface of the blank 2. As mentioned above, as the blank 2 leaves the engagement with the belt 6, adhesive is applied to the upper surface.

With the blank 8 guided onto the exposed surface of the blank 2 and into the surface-to-surface engagement, the two superimposed blanks 2 and 8 are engaged between the belt 5 and the portion 80 of the belt 11. The coefficient of friction between the engaged surfaces of the blanks 2 and 8 even with the presence of the adhesive is less than the coefficient of friction of each blank with its respective belts 5 and 11 so that different rate of movement of the belts 5 and 11 is compensated by relative movement between the two blanks.

In the preferred operation of the method and the apparatus, the belt 11 is moving faster than the belt 5 so that the leading edge of the liner 8 will contact the second abutment means 26 prior to the box blank 2 engaging the first abutment means 25. As the leading edge of the liner blank 8 engages the second abutment 26 which is being carried on the endless chain 16 at a speed less than the speed of both belts, the abutment will restrain movement of the blank and cause sliding of the liner blank on the belt 11 and on the surface of the box blank 2. This sliding continues until the leading edge of the box blank engages the first abutment means 25 which causes sliding of the box blank 2 on the belt 5. When both the box blank and the liner blank have engaged their respective abutment means, they are in the desired position for being interconnected either by the previously applied adhesive or by other mechanical joining means such as a stitching device which may be located at the discharge end of the belts adjacent to the roller 12.

As described above, the speed of the second belt 11 was faster than the speed of movement of the first belt 5 so that the liner blank was the first blank to engage its abutment. Such a selection of speeds is desirable so it could minimize sliding of the box blank 2 on the belt 5. By limiting the amount of sliding of the box blank 2, which usually has printing on the surface engaged by belt 5, damage such as mackling or soiling, which is due to the sliding of the printed box blank on the belt 5, is minimized.

The speeds of the belts 11, 5 and the chains 16 are adjusted so that the relative motion of the liner blanks compared to the box blanks will ensure engagement with the respective abutment means with the minimum amount of impact on the leading edge of each blank and so that the movement of the blanks is as smooth and continuous as possible.

Although minor modifications may be suggested by those versed in the art, it should be understood that I wish to employ within the scope of the patent granted hereon, all such modifications as reasonably and properly come within the scope of my contribution to the art.

I claim:

1. A method of applying a reinforcing liner blank in a desired position on a surface of a box blank prior to attachment thereto and particularly prior to performing a folding and gluing operation on the attached blanks comprising the steps of moving a box blank in one direction, moving a reinforcing liner blank and guiding the moving liner blank into surface-to-surface engagement with the moving box blank, moving the box blank with the liner blank engaged thereon, and subsequently shifting the box blank and liner blank relative to each other and into the desired assembled relationship so that the liner blank is in the desired position on that box blank when attached thereto.

2. A method according to claim 1, wherein said step of moving the box blank includes engaging the surface of the box blank with a first endless belt and moving the first endless belt along a first endless path, wherein the step of moving and guiding includes engaging a surface of the liner blank with a second endless belt, moving the second endless belt along a second endless path having a first portion inclined to the first endless path and a second portion extending substantially parallel to a portion of the first endless path and coacting therewith to move the box blank with the liner blank engaged thereon, and wherein the step of shifting includes providing a first abutment means for engaging a leading edge of the box blank and a second abutment means for engaging a leading edge of the liner blank, and simultaneously moving the first and second abutment means at the same speed so that as one of the blanks engages its abutment means it slips on its respective belt and the other blank moves relative thereto into engagement with its abutment means.

3. A method according to claim 2, which includes moving the second belt at a greater speed than the first belt so that the liner blank is engaged on the second abutment means prior to the engagement of the box blank on the first abutment means to minimize slippage of the box blank on the first belt.

4. A method according to claim 2, which further includes sequentially feeding box blanks onto the first belt and sequentially feeding liner blanks into engagement with the second belt.

5. A method according to claim 4, which includes applying an adhesive on a surface of the box blank after it is fed onto the first belt and prior to the step of guiding of the liner blank onto the box blank so that the blanks will be attached together after shifting to the desired position.

6. An apparatus for applying a reinforcing liner blank in the desired position on a surface of a box blank prior to attachment thereto comprising a frame, means disposed on said frame for moving a box blank in one direction, means disposed on the frame for moving a reinforcing liner blank and guiding the moving liner blank into surface-to-surface engagement with the moving box blank, means disposed on the frame for moving the box blank with the liner blank engaged thereon including means for shifting the moving box blank and liner blank relative to each other and into the desired assembled relationship so that the liner blank is in the desired position on the box blank when attached thereto.

7. An apparatus according to claim 6, wherein said means for moving the box blank includes a first endless belt engaging a surface of the box blank, means for supporting the belt for movement along a first endless path, and means for moving the belt in one direction along the path, wherein the means for moving and guiding includes a second endless belt engaging a surface of the liner blank, means for supporting the second belt for movement along a second endless path and means for moving the second belt in one direction along said second path, said means for supporting the second belt providing a portion of the second path extending parallel to a portion of the first path, said second belt in said portion of the second path coacting with the first belt in said portion of the first path to form said means for moving the box blank with the liner blank engaged thereon, and wherein said means for shifting includes at least one endless chain having a first abutment means for engaging a leading edge of a box blank and a second abutment means for engaging a leading edge of the liner blank, said chain being positioned adjacent to said parallel portions of the first and second paths to coact with the first and second endless belts to shift the moving engaged blanks relatively to each other to the desired position.

8. An apparatus according to claim 7, wherein the means for moving the second belt moves the second belt at a speed different than the means for moving the first belt.

9. An apparatus according to claim 7, wherein the means for supporting the second belt along the second path maintains spacing of said portion from the portion of the first path.

10. An apparatus according to claim 9, wherein the means for supporting includes a plurality of pressure rollers adjacent said portion of the second path for maintaining pressure on the engaged blanks passing between said portions.

11. An apparatus according to claim 10, wherein the means for supporting includes oscillating braces and said pressure rollers being mounted for rotation on said braces.

12. An apparatus according to claim 7, which further includes means disposed on the frame adjacent the shifting means for fastening the liner blank to the box blank subsequent to the blanks being shifted to the desired position.

13. An apparatus according to claim 6, which further includes means for feeding box blanks sequentially onto the means for moving the box blanks in one direction, and means for sequentially feeding liner blanks into the means for moving and guiding the liner blanks.

* * * * *